US011959205B2

(12) United States Patent
Platz et al.

(10) Patent No.: US 11,959,205 B2
(45) Date of Patent: Apr. 16, 2024

(54) METHOD TO PRODUCE A DOUBLE-LAYER KNITTED FABRIC

(71) Applicant: Essity Hygiene and Health Aktiebolag, Gothenburg (SE)

(72) Inventors: Sascha Platz, Kleve (DE); Verena Voss, Hamburg (DE); Etienne Gebel, Bocholt (DE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 17/602,797

(22) PCT Filed: Apr. 12, 2019

(86) PCT No.: PCT/EP2019/059506

§ 371 (c)(1),
(2) Date: Oct. 11, 2021

(87) PCT Pub. No.: WO2020/207600

PCT Pub. Date: Oct. 15, 2020

(65) Prior Publication Data

US 2022/0154372 A1 May 19, 2022

(51) Int. Cl.
*D04B 1/18* (2006.01)

(52) U.S. Cl.
CPC ..... *D04B 1/18* (2013.01); *D10B 2401/021* (2013.01); *D10B 2401/022* (2013.01); *D10B 2403/0114* (2013.01); *D10B 2509/028* (2013.01)

(58) Field of Classification Search
CPC . D04B 1/18; D04B 1/26; D04B 1/123; D10B 2509/028; D10B 2401/021; D10B 2401/028; D10B 2401/022
See application file for complete search history.

(56) References Cited

U.S. PATENT DOCUMENTS

| | | | |
|---|---|---|---|
| 869,986 | A | 11/1907 | Scott |
| 1,883,581 | A | 10/1932 | Thornton |
| 2,574,873 | A | 11/1951 | Conrad |
| 2,841,971 | A | 7/1958 | Bird et al. |
| 3,889,494 | A | 6/1975 | Patience et al. |

(Continued)

FOREIGN PATENT DOCUMENTS

| | | | |
|---|---|---|---|
| CH | 421359 | A | 9/1966 |
| DE | 4204339 | A1 | 8/1993 |

(Continued)

OTHER PUBLICATIONS

International Searching Authority, International Search Report issued in International Application No. PCT/EP2019/059506, dated Mar. 1, 2020 (3 pages).

(Continued)

*Primary Examiner* — Danny Worrell
(74) *Attorney, Agent, or Firm* — CANTOR COLBURN LLP

(57) ABSTRACT

A method of manufacturing a double-layer knitted fabric such as a compression article is provided. The method is performed on a knitting machine having at least two needle beds. The knitted fabric includes an outer layer made of a hydrophilic yarn on the first needle bed and an inner layer made of a hydrophobic yarn on the second needle bed. The method includes a. Forming of stitches with a hydrophilic yarn with all needles of the first needle bed and with selected needles of the second needle bed;
b. transferring the stitches made of the hydrophilic yarn and formed on the selected needles of the second needle bed to needles of the first needle bed;
c. immediately after transferring the stitches, forming of stitches with a hydrophobic yarn on the selected needles of the second needle bed as well as with all other needles of the second needle bed.

15 Claims, 2 Drawing Sheets

12 & 13: Hydrophilic yarns; 15: Hydrophobic yarns; 14: Hydrophobic inlay thread

(56) References Cited

U.S. PATENT DOCUMENTS

| | | | | |
|---|---|---|---|---|
| 3,975,929 | A | 8/1976 | Fregeolle | |
| 4,027,667 | A | 6/1977 | Swallow et al. | |
| 4,048,818 | A | 9/1977 | Cueman | |
| 4,172,456 | A | 10/1979 | Zens | |
| 4,180,065 | A | 12/1979 | Bowen | |
| 4,502,301 | A | 3/1985 | Swallow et al. | |
| 4,527,402 | A | 7/1985 | Swallow et al. | |
| 5,388,050 | A | 2/1995 | Inoue et al. | |
| 5,735,145 | A * | 4/1998 | Pernick | A61F 13/53 66/196 |
| 5,896,758 | A * | 4/1999 | Rock | A43B 23/0205 66/194 |
| 6,151,922 | A * | 11/2000 | Shimasaki | D04B 1/02 66/61 |
| 6,427,493 | B1 * | 8/2002 | Kasdan | D04B 1/16 66/202 |
| 6,725,691 | B2 | 4/2004 | Yakopson | |
| 7,043,329 | B2 | 5/2006 | Dias et al. | |
| 7,360,378 | B2 * | 4/2008 | Foshee | D04B 1/14 66/196 |
| 7,895,863 | B2 | 3/2011 | Smith et al. | |
| 8,317,736 | B2 | 11/2012 | Mrkus et al. | |
| 9,534,324 | B2 | 1/2017 | Lonati et al. | |
| 9,777,413 | B2 | 10/2017 | Messier | |
| 9,828,705 | B1 * | 11/2017 | Shiue | D04B 1/12 |
| 10,271,581 | B2 | 4/2019 | Kehler et al. | |
| 10,273,607 | B2 | 4/2019 | Stein et al. | |
| 10,645,978 | B2 | 5/2020 | Kehler et al. | |
| 10,900,152 | B2 | 1/2021 | Sasaki | |
| 10,954,614 | B2 | 3/2021 | Giorgini | |
| 11,131,044 | B2 | 9/2021 | Convert et al. | |
| 11,134,725 | B2 | 10/2021 | Erkus et al. | |
| 11,560,651 | B2 | 1/2023 | Rock et al. | |
| 2005/0049741 | A1 | 3/2005 | Dias et al. | |
| 2010/0130903 | A1 | 5/2010 | Rock | |
| 2016/0076175 | A1 | 3/2016 | Rock et al. | |
| 2017/0247822 | A1 | 8/2017 | Atmanspacher | |
| 2018/0353345 | A1 | 12/2018 | Sasaki | |
| 2020/0385901 | A1 * | 12/2020 | Lawrence | D04B 21/04 |
| 2021/0130992 | A1 | 5/2021 | Platz et al. | |

FOREIGN PATENT DOCUMENTS

| | | | |
|---|---|---|---|
| DE | 19616005 | A1 | 10/1997 |
| DE | 20207156 | U1 | 8/2002 |
| DE | 20309726 | U1 | 9/2003 |
| DE | 102006048313 | A1 | 4/2008 |
| DE | 102008031845 | A1 | 1/2010 |
| DE | 102012004150 | A1 | 8/2013 |
| DE | 102015115228 | B3 | 9/2016 |
| DE | 202017100286 | U1 | 4/2018 |
| EP | 0522778 | B1 | 8/1997 |
| EP | 0989219 | A2 | 3/2000 |
| EP | 1321551 | A1 | 6/2003 |
| EP | 1621164 | A1 | 2/2006 |
| EP | 2075361 | A1 | 7/2009 |
| EP | 2436276 | A1 | 4/2012 |
| EP | 3085822 | A1 | 10/2016 |
| EP | 3214213 | A1 | 9/2017 |
| EP | 3251641 | A1 | 12/2017 |
| EP | 3572570 | A1 | 11/2019 |
| WO | 9207128 | A1 | 4/1992 |
| WO | 03040449 | A1 | 5/2003 |
| WO | 2005106087 | A1 | 11/2005 |
| WO | 2006064816 | A1 | 6/2006 |
| WO | 2010006051 | A1 | 1/2010 |

OTHER PUBLICATIONS

International Searching Authority, International Preliminary Reporton Patentability issued in International Application No. PCT/EP20198/059506, dated Jul. 20, 2021 (12 pages).

International Searching Authority, Search Report issued in International Application No. PCT/ EP2019/063124, mailed Jul. 9, 2019 (5 pages).

PCT International Preliminary Report on Patentability; International Application No. PCT/EP2019/063124; International Filing Date: May 21, 2019; Date Mailed: Nov. 24, 2020; pp. 1-8.

PCT ISR Written Opinion with English Translation; International Application No. PCT/EP2019/063124; International Filing Date: May 21, 2019; Date of Mailing: Jul. 9, 2019; pp. 1-14.

US Non-Final Office Action for U.S. Appl. No. 17/057,158, filed Nov. 20, 2020; Action Mailed: May 11, 2023; pp. 1-16.

Advertising Brochure; "EquiCrown® Compression Bandages"; Aug. 2014; 6 pages.

Advertising Brochure; "EquiCrown® Medical Compression Bandages"; Jun. 2013; 2 pages.

Affidavit of Mr. Yusuke Miyaj; Date: Feb. 10, 2023; 2 pages.

Confirmation from the company SHIMA SEIKE MFG., LTD, Japan, regarding the publication of a knitting program 5249WOOF for the production of a compression sock; Date: Aug. 17, 2022; 1 page.

Database extract regarding incoming orders and order No. for Teccons eK Reisholzstr. 39, 40721 Hilden; Date: Jan. 16, 2014; 1 page.

Delivery confirmation for a compression stocking knitted according to the program Y5249WOOF; Date: May 3, 2022; 2 pages.

Delivery Note from Julius Zorn GmbH to Pet Physio c/o MBE Mailboxes ect.; Lieferschein 103401000360; Date: Jan. 16, 2014; 3 pages.

EquiCrown® Price List; Julius Zorn GmbH; May 2014; 1 page.

Invoice from Julius Zorn GmbH to Pet Physio c/o MBE Mailboxes ect.; Rechnung 103401000360; Date: Jan. 16, 2014; 3 pages.

Notice of Opposition to European Patent EP3572570B1 with English translation; Patent Proprietor: BSN-Jobst GmbH; Opponent: Medi GmbH & Co. KG; Dated Feb. 21, 2023; 127 pages.

Notice of Opposition to European Patent EP3572570B1 with English translation; Patent Proprietor: BSN-Jobst GmbH; Opponent: Ofa Bamberg GmbH; Dated Feb. 20, 2023; 67 pages.

Order From Teccons eK, Reisholzstr. 39, 40721 Hilden vom; Date: Jan. 16, 2014; 3 pages.

Picture bundle with Pictures E20a—E20i for an EquiCrown@ compression bandage art 6600 PVK Gr. 1, Produced on Date: Jul. 11, 2013; 9 pages.

Picture bundle with the pictures E24a—E24e concerning the exhibition of a compression stocking knitted according to the program Y5249WOOF at the anniversary celebration for the 55th anniversary of the company SHIMA SEIKE MFG., LTD on Nov. 16-17, 2017; 3 pages.

Picture set with pictures E26a-E26f concerning the Compression stocking knitted according to the program Y5249W0OF; Date registered: Nov. 13, 2017; 5 pages.

Pictures E21a-E21h of EquiCrown compression bandage with enlarged view and designation of various relevant knitting areas; Jul. 11, 2013; 3 pages.

Proof of registration of the knitting program Y5249WOOF from Nov. 13, 2017 on the user website of SHIMA SEIKE MFG., LTD for user download; Date: Nov. 13, 2017; 1 page.

Quality assurance RAL-GZ 387/1 "Medical Compression Hosiery", Jan. 2008 edition, of the German Institute for Quality Assurance and Certification; 24 pages.

(56) References Cited

OTHER PUBLICATIONS

Response to Notice of Opposition to European Patent EP3572570B1; In the name of BSN-Jobst GmbH; Opponent 1: Medi GmbH; Opponent 2: OFA Bamberg GmbH; Dated Jul. 11, 2023; 25 pages.
Textbook "Compression therapy"; K. Protz, 1. Dissmond, K. Kröger, Heidelberg 2016; ISBN: 978-3-662-49743-2.

* cited by examiner

12 & 13: Hydrophilic yarns; 15: Hydrophobic yarns; 14: Hydrophobic inlay thread

METHOD TO PRODUCE A DOUBLE-LAYER KNITTED FABRIC

CROSS-REFERENCE TO RELATED APPLICATION

This application is a national phase entry of, and claims priority to, International Application No. PCT/EP2019/059506, filed Apr. 12, 2019, with the same title as listed above. The above-mentioned patent application is incorporated herein by reference in its entirety.

TECHNICAL FIELD

This application relates to a method of manufacturing a double-layer knitted fabric, especially a compression article, on a knitting machine having at least two needle beds, and where the knitted fabric includes an outer layer made of a hydrophilic yarn on the first needle bed and an inner layer made of a hydrophobic yarn on the second needle bed.

BACKGROUND

The inner layer of knitted fabrics of the above-mentioned type acts to move moisture away from the skin of the wearer of a garment made of such a knitted fabric. Especially compression articles and medical garments like stockings, bandages and medical soft goods that usually are worn many hours every day have to guarantee that moisture caused by perspiration is moved away from the wearer's skin to avoid discomfort or even skin irritations.

German Patent Application Publication No. DE 42 04 339 A1 for example describes such a medical knitted garment having a hydrophobic inner layer and at least one outer layer that is able to store moisture. By a capillary effect the inner layer is moving moisture from the skin to the outer layer. The hydrophobic yarn of the inner layer is floated over several needles and/or forms bows and loops on the inner surface of the garment. The disadvantage of these garments are the relatively extended areas where the outer layer made of a hydrophilic material can still touch the skin of a wearer and therefore cause discomfort by retaining the moisture close to the skin.

Another fabric according to the state of the art has an inner hydrophobic layer knitted on a first needle bed and a hydrophilic outer layer knitted on the second needle bed. However, some of the needles of the first needle bed knit the hydrophilic yarn that is used to form the outer layer. These hydrophilic stitches within the inner layer move the moisture away from the skin into the outer layer. However, also this fabric can cause discomfort because the hydrophilic stitches in the inner layer touch the skin of a wearer. And only the feet of the stitches are able to transport the moisture into the second layer what still retains a lot of moisture close to the skin.

It would therefore be desirable to provide a method to manufacture a double layer knitted fabric having an inner hydrophobic layer and an outer hydrophilic layer capable of providing more comfort for a wearer of a garment made of such a fabric.

SUMMARY

This objective is achieved by a method of manufacturing a double-layer knitted fabric in accordance with one embodiment of the invention, especially a compression article, on a knitting machine having at least two needle beds, wherein the knitted fabric comprises an outer layer made of a hydrophilic yarn on the first needle bed and an inner layer made of a hydrophobic yarn on the second needle bed, wherein stitches with the hydrophilic yarn are also knitted on selected needles of the second needle bed, that is characterized by comprising the steps of and carried out in the following order:

a. Forming of stitches with a hydrophilic yarn material with all needles of the first needle beds and with selected needles of the second needle bed;
b. Transferring the stitches made of the hydrophilic yarn material and formed on the selected needles of the second needle bed to needles of the first needle bed;
c. immediately after transferring the stitches in step b. forming of stitches with a hydrophobic yarn material on the selected needles of the second needle bed (=split-stitches) as well as with all other needles of the second needle bed.

By splitting the stitches originally formed on selected needles of the second needle bed and knitted by a hydrophilic yarn the heads of these stitches are incorporated in the outer layer after the transfer of these stitches in step b and replacing them on the second needle bed by hydrophobic stitches. Only the legs and feet of each of these split stitches are part of the inner layer touching the skin of a wearer of a garment made of such a fabric. Therefore, less moisture is retained in the inner layer close to the wearer's skin. On the other hand, not only the feet of these stitches but also the legs are able to move moisture away from the skin into the outer layer. Thus, the push and pull effect on the skin moisture is considerably better than in fabrics according to the state of the art. The wearer of such a garment feels dry and comfortable.

Further benefits can be obtained if before the transfer of stitches in step b. an inlay thread is laid onto the stitches made of hydrophilic yarn and extending between the two needle beds.

Inlay threads are frequently used in compression articles to provide the desired compression on the wearer's body part. By inserting these threads before the stitch transfer in step b. the threads can be fixed in the fabric by the transferred stitches.

The inlay threads are usually elastic threads especially if the fabric is a compression article. They can also be hydrophobic threads or have a hydrophobic coating. It is also common to use inlay threads having an elastic core that is covered by a hydrophobic fiber material.

In order to fix the inlay threads safely in the fabric it is advantageous if in step b. the stitches from selected needles of the second needle bed are transferred to needles of the first needle bed that are laterally offset with regard to the selected needles of the second needle bed. In this way, the stitches transferred in step b. are wrapped around the inlay thread and fix it securely.

In a preferred embodiment of the method of the invention in step a. stitches are formed with a hydrophilic yarn on every second needle of the second needle bed. Thus, every second stitch in a course on the second needle bed is a split stitch that is capable of moving moisture away from the skin. However, these stitches can also be formed further spaced apart from each other depending on the use of the fabric.

It is also possible to knit one or more courses with a hydrophilic yarn on all needles of the first needle bed after step a, i.e. before transferring back the stitches on selected needles of the second needle bed to needles of the first needle bed in step b. Thus, courses with split stitches are spaced further apart from each other.

In order to knit a whole garment or larger areas of the fabric having good moisture discharging properties steps a. to c. are repeated several times wherein each time in step a. the stitches on selected needles of the second needle bed are formed on different needles than in the preceding execution of step a. Thus, the split stitches are distributed evenly over the fabric.

It is further preferable that a moisture transporting and/or an elastic yarn is used as a hydrophilic yarn. If the hydrophilic yarn has capillaries moisture can easily be moved away from the skin. Especially for a compression article it is also advantageous if the hydrophilic yarn is elastic. For the same reason, also the hydrophobic yarn can be an elastic yarn.

Further embodiments of the invention relate to a double layer knitted fabric, in particular a compression article, comprising an outer layer made of a hydrophilic yarn and an inner layer made of a hydrophobic yarn and manufactured by a method according to the invention and characterized in that the inner layer of the fabric has spaced apart split stitches made of a hydrophilic yarn.

BRIEF DESCRIPTION OF THE DRAWINGS

The features and advantages of the invention will be appreciated upon reference to the following drawings. The accompanying drawings, which are incorporated in and constitute a part of this specification, illustrate one or more embodiments of the invention and, together with the general description given above and the detailed description given below, explain the one or more embodiments of the invention.

DETAILED DESCRIPTION

Figure 1:
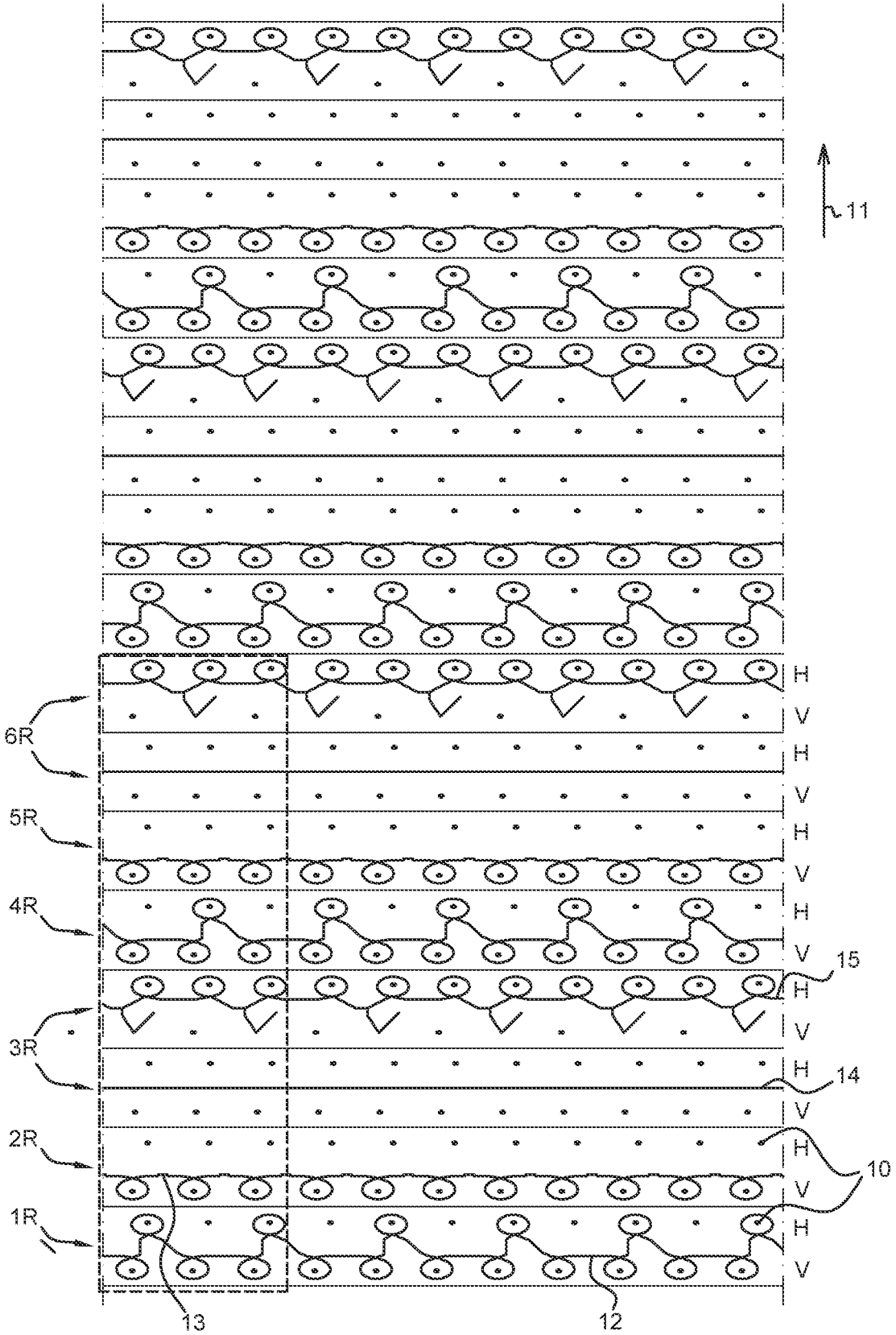
FIG. 1 shows a knitting process diagram for a section of a fabric, in accordance with one embodiment of the present invention.

The diagram of FIG. 1 shows a sequence of courses knitted on a front needle bed V and a rear needle bed H of a flat knitting machine wherein the needles of these needle beds V, H are marked by dots 10. The knitting direction is indicated by an arrow 11.

In a first course 1R stitches are knitted with a hydrophilic yarn 12 on all needles of the front needle bed V and on every second needle of the rear needle bed. On the front needle bed V an outer hydrophilic layer of the fabric is knitted and on the rear needle bed an inner and hydrophobic layer. In a second course 2R stitches are knitted with a second hydrophilic yarn 13 on all needles of the front needle bed V. This course 2R is optional. Instead of a different yarn 13 again yarn 12 could be used to knit this course 2R.

In a third course 3R that is pictured as two separate courses just for reasons of clarity an inlay thread 14 is laid between the stitches formed in the previous courses 1R and 2R on the front and rear needle bed V, H. Immediately after placing the inlay thread 14 the stitches of the rear needle bed H formed in course 1R are transferred to the opposite needles of the front needle bed V and on all needles on the rear needle bed H stitches are formed with a hydrophobic yarn 15. The transferred stitches or split stitches fix the inlay thread 14 in the fabric. Their feet are still on the rear needle bed H and therefore part of the inner hydrophobic layer of the fabric. Thus, these stitches are able to move moisture from the inner layer to the outer layer of the fabric.

The courses 4R to 6R are a repetition of courses 1R to 3R with the one difference that in course 4R stitches are formed with the hydrophilic yarn 12 on needles of the rear needle bed that have not formed stitches with that yarn 12 in course 1R. In further repetitions of courses 1R to 3R the knitting of these stitches on the rear needle bed H always alters between odd and even needles of the rear needle bed. Thus, the split stitches can be uniformly distributed over the surface of the inner layer of the fabric.

It is also possible to knit only on every third needle of the rear needle bed H in course R1 with yarn 12. In further repetitions of course R1 each time the first needle on which a stitch with yarn 12 is formed is moved by one to the right in order to achieve a uniform distribution of the split stitches.

Figure 2:
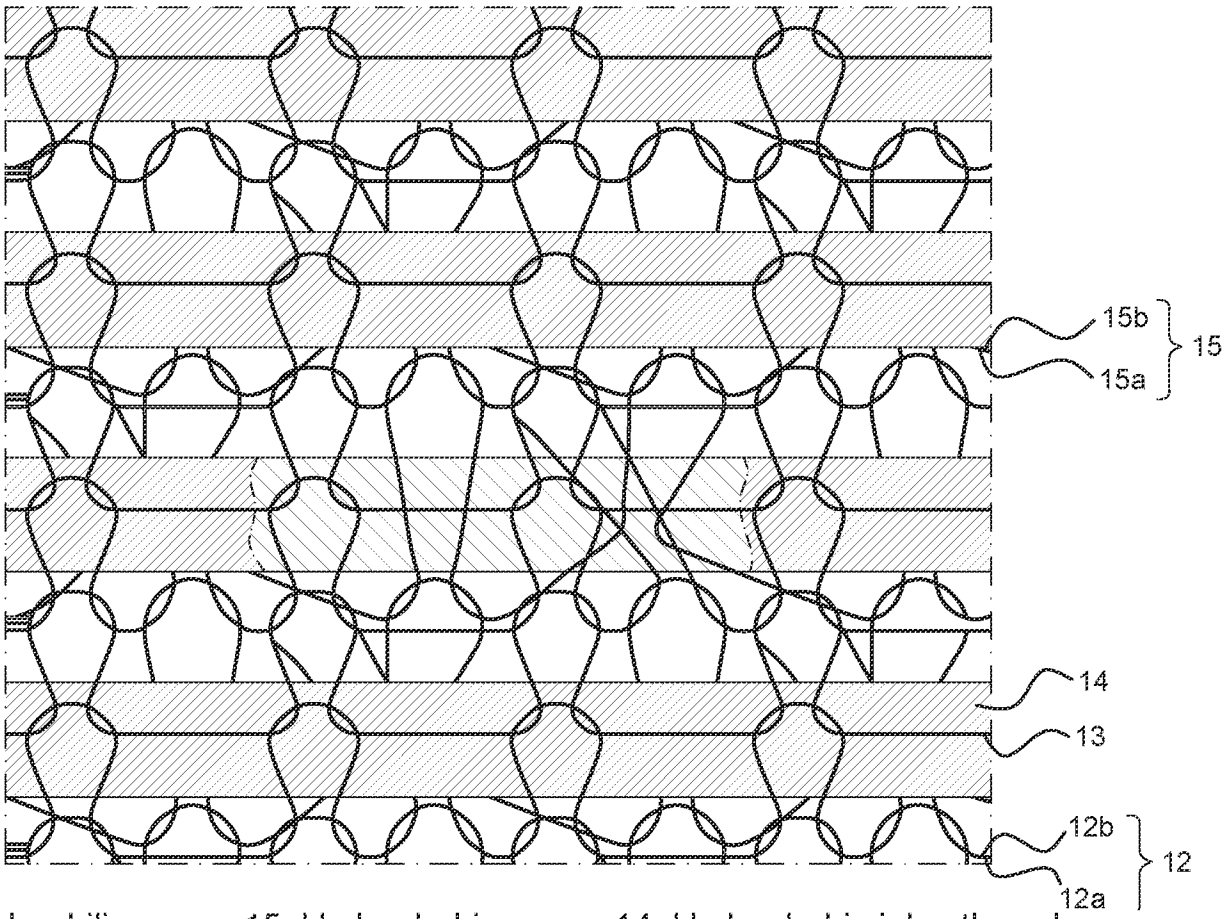
FIG. 2 shows a portion of a double layer knitted fabric that may be made by the method of embodiments of the present invention.

The stitch pattern picture of a double layer knitted fabric in FIG. 2 shows a view onto the outer layer formed by hydrophilic yarns 12, 13 wherein the yarn 12 is formed by two yarns 12*a*, 12*b*. The inner layer is formed by stitches made of hydrophobic yarns 15*a*, 15*b*. Also, elastic inlay threads 14 are hydrophobic. In the center portion of FIG. 2 the inlay thread 14 is omitted and a split stitch formed by hydrophilic yarns 12 can be seen. Its feet are part of the inner layer while its head and legs are part of the outer layer. Thus, moisture can be moved from the inside of the fabric to the outer layer.

The embodiments described above are descriptions of preferred embodiments of the present invention, and are not intended to limit the scope of the present invention. Various variations and modifications can be made by those of ordinary skill in the art, without departing from the design and scope of the present invention. The variations and modifications should all fall within the claimed scope defined by the claims of the present invention.

What is claimed is:

1. A method of manufacturing a double-layer knitted fabric on a knitting machine comprising:

a first needle bed and a second needle beds, wherein the knitted fabric comprises an outer layer made of a hydrophilic yarn on the first needle bed and an inner layer made of a hydrophobic yarn on the second needle bed, wherein stitches with the hydrophilic yarn are also knitted on selected needles of the second needle bed, the method comprising the steps of and carried out in the following order:

a. Forming of stitches with a hydrophilic yarn with all needles of the first needle bed and with selected needles of the second needle bed;

b. transferring the stitches made of the hydrophilic yarn and formed on the selected needles of the second needle bed to needles of the first needle bed;

c. immediately after transferring the stitches in step (b) forming of stitches with a hydrophobic yarn on the selected needles of the second needle bed as well as with all other needles of the second needle bed such that the inner layer of the fabric has spaced apart split stitches of hydrophilic yarn.

2. The method of manufacturing a knitted fabric according to claim 1, wherein before the transfer of stitches in step (b) an inlay thread is laid onto the stitches made of hydrophilic yarn and extending between the two needle beds.

3. The method of manufacturing a knitted fabric according to claim 2, wherein the inlay thread is an elastic thread.

4. The method of manufacturing a knitted fabric according to claim 2, wherein the inlay thread is a hydrophobic thread or has a hydrophobic coating.

5. The method of manufacturing a knitted fabric according to claim 1, wherein in step (b) the stitches from selected needles of the second needle bed are transferred to needles of the first needle bed that are laterally offset with regard to the selected needles of the second needle bed.

6. The method of manufacturing a knitted fabric according to claim 1, wherein in step (a) on every second needle of the second needle bed stitches are formed with a hydrophilic yarn.

7. The method of manufacturing a knitted fabric according to claim 1, wherein after step (a) a course is knitted with a hydrophilic yarn on all needles of the first needle bed.

8. The method of manufacturing a knitted fabric according to claim 1, wherein steps (a) to (c) are repeated several times wherein each time in step a. the stitches on selected needles of the second needle bed are formed on different needles than in the preceding execution of step (a).

9. The method of manufacturing a knitted fabric according to claim 1, wherein a moisture transporting and/or an elastic yarn is used as a hydrophilic yarn.

10. The method of manufacturing a knitted fabric according to claim 1, wherein the hydrophobic yarn is an elastic yarn.

11. The method of manufacturing a knitted fabric according to claim 1, wherein the knitted fabric is a compression article.

12. The method of manufacturing a knitted fabric according to claim 1, wherein the knitted fabric is a garment and the inner layer is for touching a skin of a wearer of the garment.

13. A double layer knitted fabric comprising:

an outer layer made of a hydrophilic yarn and an inner layer made of a hydrophobic yarn, wherein the inner layer of the fabric has spaced apart split stitches made of the hydrophilic yarn wherein heads of the split stitches are incorporated in the outer layer, and legs and feet of each of these split stitches are part of the inner layer.

14. A compression article or medical garment comprising a double layer knitted fabric according to claim 13.

15. The compression article or medical garment of claim 14, wherein the compression article or medical garment is a stocking, bandage or medical soft good.

* * * * *